US008307467B2

(12) United States Patent
Bulala et al.

(10) Patent No.: US 8,307,467 B2
(45) Date of Patent: Nov. 13, 2012

(54) TOILET DEVICE WITH INDICATOR

(75) Inventors: Cherie A. Bulala, Albany, CA (US); Grant Templin, Dublin, CA (US); Geetha Murthy, Oakland, CA (US); Rina Mussallam, Mountain House, CA (US); Matt Tivnon, Ladera Ranch, CA (US); Bryan Vollmer, Trabuco Canyon, CA (US)

(73) Assignee: The Clorox Company, Oakland, CA (US)

( * ) Notice: Subject to any disclaimer, the term of this patent is extended or adjusted under 35 U.S.C. 154(b) by 1248 days.

(21) Appl. No.: 11/844,085

(22) Filed: Aug. 23, 2007

(65) Prior Publication Data

US 2009/0049588 A1 Feb. 26, 2009

(51) Int. Cl.
*E03D 9/00* (2006.01)

(52) U.S. Cl. ..... 4/228.1

(58) Field of Classification Search ..... 4/222–233
See application file for complete search history.

(56) References Cited

U.S. PATENT DOCUMENTS

| | | | | |
|---|---|---|---|---|
| 3,760,433 | A | 9/1973 | Mallin | |
| 3,796,350 | A | 3/1974 | Hauter | |
| 3,914,805 | A * | 10/1975 | Dolan | 4/228.1 |
| 4,064,573 | A | 12/1977 | Calderone | |
| 4,209,864 | A * | 7/1980 | Lindauer | 4/227.4 |
| 4,216,027 | A | 8/1980 | Wages | |
| 4,357,718 | A | 11/1982 | Corsette | |
| 4,358,860 | A | 11/1982 | Church | |
| 4,552,693 | A | 11/1985 | Hussain et al. | |
| 4,670,916 | A | 6/1987 | Bloom | |
| 4,824,827 | A * | 4/1989 | Kelly et al. | 512/1 |
| 5,018,633 | A | 5/1991 | Toth et al. | |
| 5,125,119 | A | 6/1992 | Munoz | |
| 5,345,617 | A | 9/1994 | Jahner et al. | |
| 5,774,903 | A * | 7/1998 | Wilson et al. | 4/227.1 |
| 5,800,741 | A * | 9/1998 | Glenn et al. | 261/107 |
| 5,871,153 | A | 2/1999 | Doggett, Jr. | |
| 6,055,679 | A | 5/2000 | Goelz et al. | |
| 6,178,564 | B1 | 1/2001 | Leonard et al. | |
| 6,254,969 | B1 * | 7/2001 | Eberle | 428/195.1 |
| 6,279,173 | B1 | 8/2001 | Denzin et al. | |
| 6,311,340 | B1 | 11/2001 | Thompson | |
| 6,341,385 | B1 | 1/2002 | Downes | |
| 6,349,913 | B1 | 2/2002 | Jankowski | |
| 6,389,610 | B1 | 5/2002 | Hautmann et al. | |
| 6,412,120 | B1 | 7/2002 | Leonard et al. | |
| 6,435,423 | B2 | 8/2002 | Hurry et al. | |

(Continued)

FOREIGN PATENT DOCUMENTS

| | | |
|---|---|---|
| EP | 730065 | 9/1996 |

(Continued)

*Primary Examiner* — Lori Baker
(74) *Attorney, Agent, or Firm* — Thomas C. Feix

(57) ABSTRACT

Described is a multi-function device for attachment to the tank of a toilet fixture. The multi-function device provides a diffusible air-treatment concentrate for deodorizing or otherwise treating the ambient air surrounding the toilet. At the same time, the multi-function device provides a water-soluble water-treatment concentrate for treating the flush water stored in the toilet tank. The multi-function device has an indicator to advise the consumer when replacement of user serviceable parts, such as the water treatment concentrate and the air treatment concentrate, is needed. The multi-function device has a bellows with a varying cross-sectional area to provide, during a flush cycle, a variable flow of air over the air treatment concentrate and into the air.

10 Claims, 8 Drawing Sheets

U.S. PATENT DOCUMENTS

| | | | | |
|---|---|---|---|---|
| 6,479,456 | B1 | 11/2002 | Holzner | |
| 6,510,561 | B1 | 1/2003 | Hammond et al. | |
| 6,526,598 | B1 | 3/2003 | Black | |
| 6,591,431 | B2 | 7/2003 | Hautmann et al. | |
| 6,607,778 | B2 | 8/2003 | Mutka et al. | |
| 6,625,821 | B2 | 9/2003 | Lhoste | |
| 6,651,261 | B1 | 11/2003 | Leonard et al. | |
| 6,662,380 | B1 | 12/2003 | Leonard et al. | |
| 6,738,989 | B2 | 5/2004 | Harbutt | |
| 6,748,610 | B2 | 6/2004 | Zach et al. | |
| 2004/0068781 | A1 | 4/2004 | Hill | |
| 2004/0128751 | A1 | 7/2004 | Haq | |
| 2005/0138720 | A1 * | 6/2005 | Shim | 4/213 |
| 2006/0102738 | A1 | 5/2006 | Gusenoff et al. | |
| 2006/0130227 | A1 | 6/2006 | Belford | |
| 2009/0049587 | A1 | 2/2009 | Bulala et al. | |

FOREIGN PATENT DOCUMENTS

| | | | |
|---|---|---|---|
| WO | WO8203883 | | 11/1982 |
| WO | WO8203883 | A1 | 11/1982 |
| WO | WO00/42260 | A1 | 7/2000 |
| WO | WO00/42261 | A1 | 7/2000 |
| WO | WO00/53718 | A1 | 9/2000 |
| WO | WO01/96676 | A1 | 12/2001 |
| WO | WO02/064898 | A1 | 8/2002 |
| WO | WO03/054311 | A1 | 7/2003 |
| WO | WO2005001212 | | 1/2005 |
| WO | WO2006000917 | | 1/2006 |
| WO | WO2006013321 | | 2/2006 |
| WO | WO2006013322 | | 2/2006 |

* cited by examiner

TOILET DEVICE WITH INDICATOR

BACKGROUND OF THE INVENTION

1. Field of the Invention

This invention relates generally to multi-function dispensers and, more specifically, to a device for diffusing an air-treatment concentrate to the ambient air surrounding a toilet and for dispersing a water-treatment concentrate to the tank of the toilet. The present invention further relates to indicator devices for advising consumers when to replace certain components of the multi-function dispensers.

2. Description of the Related Art

Assemblies for diffusing air-treatment concentrates are well known. Such air-treatment assemblies were used to provide an air-diffused fragrance to mask offensive odors in the living areas of a house or the work and service areas of commercial environments. Diffusion of masking fragrances was especially useful in bathrooms and kitchen areas that were subject to a higher incidence of offensive odors. Assemblies were also used to diffuse an air-treatment concentrate capable of otherwise treating ambient air. Various means were developed to improve the diffusion of fragrances or treatment concentrates from the assemblies of the prior art. For example, fan assists were included in the assemblies to increase airflow across the air-treatment concentrate and thus the diffusion of the concentrate in ambient air. Heating elements were also included in some prior art assemblies to increase the temperature of the air-treatment concentrate to aid in volatilization of the concentrate and thus the diffusion of the concentrate.

Assemblies for discharging a water-treatment concentrate to the flush water contained in the tank or bowl of a toilet are also well known in the art. Such water-treatment assemblies were used to clean, color, or otherwise treat the water used to flush the toilet.

One type of such prior art water-treatment assembly, sometimes referred to as a "tank-hanger" assembly, pretreated the flush water by placement of a water-treatment concentrate directly in the toilet tank, or by placement of a water-treatment concentrate in a housing or reservoir. One type of tank-hanger assembly was the "active" assembly, which pumped or siphoned a solution of dissolved water-treatment concentrate into the toilet tank, usually at the flush cycle (See, for example, U.S. Pat. No. 4,357,718 by Corsette). With an active assembly, the housing containing the water-treatment concentrate could be located inside the toilet tank above the fill-level of the toilet tank or could be located completely or partially below the fill-level. Another type of tank-hanger assembly was the "passive" assembly, in which the water-treatment concentrate was placed inside the toilet tank in a housing at least partially submerged below the toilet tank fill-level. The water-treatment concentrate then passively dispersed in the tank water during the quiescent period between toilet flushes (See, for example, U.S. Pat. No. 4,216,027 by Wages).

Another type of prior art water-treatment assembly, sometimes referred to as a "rim-hanger" assembly, treated the flush water flowing from the rim of the toilet bowl only during the flush cycle. Since a rim-hanger assembly treated the flush water only during the short time of the flush cycle, it was generally ineffective in providing the treatment level provided by a tank-hanger assembly. As noted earlier, in a tank-hanger assembly a dispersible water-treatment concentrate, such as a hypochlorite tablet or puck, could be placed in continuous contact with the flush water stored in the toilet tank. No rim-hangers can currently claim sanitization or superior cleaning to tank-hanger dispersed hypochlorite tablets.

Further, attempts were made in the prior art to include air-treatment concentrates with the water-treatment concentrates contained in both tank-hanger and rim-hanger prior art assemblies. However, the approach of including air-treatment concentrates within the water-treatment concentrates proved an ineffective means to achieve air freshening of the ambient bathroom air surrounding a toilet fixture. In the case of tank-hangers, air-treatment concentrate, which diffused into the headspace above the toilet tank fill-level, did not have an effective exit point from the enclosed toilet tank to enter the ambient air. In the case of rim-hangers, the periodic dosing of the ambient air only during the flush cycle of the toilet proved ineffective in providing continuous air freshening of the general bathroom air. Rim-hangers had the additional disadvantage of being unsightly and, after the recommended four to six weeks of continuous use, becoming germ laden.

Accordingly, what is needed is a simple, easy-to-use device that provides, in combination, effective toilet flush water-treatment and that further provides effective continuous treatment of the ambient bathroom air surrounding the toilet fixture.

SUMMARY OF THE INVENTION

In accordance with the principles of the present invention, in one embodiment, a device comprises a water treatment part for mounting inside a toilet tank; an air moving part for mounting inside a toilet tank; an air treatment part in communication with the air moving part; an indicator at least partially viewable from an exterior of the toilet tank; and a bellows formed from an interior of the air moving part, wherein air displaced from the bellows moves through the air treatment part; and wherein the indicator indicates when a user should change user serviceable components of the device.

According to another embodiment of the present invention, a multi-function toilet device comprises an air moving part having at least a portion of which that is soluble in water over a period of time; an air treatment part in communication with the air moving part; and a bellows formed from an interior of the air moving part, wherein an amount of air displaced from the bellows and delivered to the air treatment part varies through a flush cycle.

According to a further embodiment of the present invention, a multi-function toilet device comprises an air moving part for mounting inside a toilet tank; a water treatment part containing a water treatment concentrate for mounting inside a toilet tank; an air treatment part in communication with the air moving part; a bellows formed from an interior of the air moving part; a space above the water treatment concentrate receiving water from the toilet tank when the water treatment concentrate needs replacement; and a wick receiving water form the space; wherein air displaced from the bellows moves through the air treatment part; and wherein the wick is disposed at least partially on an exterior of the toilet tank.

To use the multi-function toilet device of the present invention, the tank lid of the toilet is removed, the connector may be placed over the lip of the toilet tank to position the air-treatment concentrate adjacent the exterior surface of the toilet tank and to position the water-treatment concentrate adjacent the interior surface of the toilet tank. In one embodiment, the air-treatment concentrate may be located adjacent the interior surface of the toilet tank, above the fill-level of the toilet tank, with a vent communicating the air-treatment concentrate to the exterior of the toilet tank. In one embodiment, the water-treatment concentrate may be positioned at least partially below the fill-level of the toilet tank. After placement of the connector and positioning of the air-treatment and water-treatment concentrates, the tank lid is replaced on the toilet tank over the connector. The bellows may be located inside the toilet tank so that the water level inside the toilet tank immediately after flush is below the bellows and the water level inside the toilet tank at the filled level covers at least a portion of the bellows.

In one embodiment, the multi-function toilet device of the present invention further includes an air-treatment housing coupled to the air-treatment end portion of the connector and a water-treatment housing coupled to the water-treatment end portion of the connector, opposite the air-treatment end portion of the connector. As described in the various embodiments below, the water-treatment housing may form the bellows, may be a separate entity from the bellows, may be nested in the bellows or may be formed integrally with the bellows. Disposed within the air-treatment housing is the air-treatment concentrate and disposed within the water-treatment housing is the water-treatment concentrate.

The air-treatment housing can include a heating element or a fan coupled to the multi-function toilet device to enhance diffusion of the air-treatment concentrate. The water-treatment housing can be an active device, which provides pumping or siphoning of an aliquot of water-treatment concentrate pre-mixed with toilet tank water. Alternatively, the water-treatment housing can be a passive device, which merely contains and positions the water-treatment concentrate at least partially below the toilet tank fill-level to passively disperse into the tank water.

The air and water-treatment housings can be adjustably coupled to the connector to allow suitable positioning of the housings upon installation of the multi-function toilet device of the present invention. In one embodiment, the air and water-treatment housings are slideably adjustable along a connector.

The connector can take alternate shapes. In one embodiment, the connector is a planer ribbon configured generally as a rigid inverted "J" shaped bracket. The inverted "J" has a "top" intermediate the two unequal length "legs" that makeup the air-treatment and water-treatment end portions of the connector such that the top contacts the lip of the toilet tank and the legs hang adjacent the interior and exterior of the toilet tank to suitably position the air-treatment concentrate and water-treatment concentrate, respectively. In another embodiment, there may be two hanging parts with a water-treatment end portion nested inside the air-treatment portion. In another embodiment, the connector is generally shaped in the form of an inverted "U", having the air-treatment end portion and the water-treatment end portion of equal length. Various other configurations of the connector are possible and would be apparent to those of ordinary skill in the art. For example, the connector may be simply shaped as an inverted "L" having only one end portion.

In yet another embodiment, the connector is a planar ribbon having living hinges, well known to those of ordinary skill in the art, and adapted to allow folding of the connector into, for example, the inverted "J", "U", or "L" configurations described and to allow adjustment of the air-treatment and water-treatment housings for suitable positioning at installation of the multi-function toilet device. In one embodiment, the connector is a bendable wire, band, ribbon, or tube configurable as described above to accommodate placement on the toilet tank and positioning of the air-treatment and water-treatment housings adjacent the toilet tank interior surface and exterior surface, respectively. For these embodiments, the multi-function toilet device may be conveniently packaged in a flat folded configuration and bent to a suitable configuration before use.

In yet another embodiment, the connector is not placed over the tank lip but is rather attached to the removable toilet tank lid such that the air-treatment concentrate is positioned adjacent the exterior surface of the tank and the water-treatment concentrate is positioned adjacent the interior surface of the tank when the toilet tank lid is replaced.

The connector, air-treatment and water-treatment housings of the multi-function toilet device of the present invention can be made of any suitable material. Exemplary materials include but are not limited to metal, and metal composites, ceramics, polypropylene (PP), polyethylene (PP), high density polyethylene (HDPE), polyethylene terephthalate (PET), polystyrene (PS), acrylonitrile-butadiene-styrene (ABS), polymer composites, and other engineered plastics that may be formed with a variety of fabrication technologies, such as, for example, thermoforming or blowmolding. Alternatively, the air-treatment housing may be made at least partially of water treatment material which may dissolve away as it treats the water. The air-treatment housing may be designed to dissolve away at such a time when it may be desirable to replace user serviceable components, such as the air treatment portion.

The multi-function toilet device of the present invention can be disposed after depletion of the water-treatment and air-treatment concentrates or can be refillable with the concentrates. Further, the device of the present invention can include one or more indicia that alert the user that the air or water-treatment concentrates are depleted.

Further features and advantages of the present invention will become apparent to those of ordinary skill in the art in view of the detailed description of embodiments below, when considered together with the attached drawings and claims.

BRIEF DESCRIPTION OF THE DRAWINGS

The foregoing aspects and others will be readily appreciated by the skilled artisan from the following description of illustrative embodiments when read in conjunction with the accompanying drawings, in which.

DETAILED DESCRIPTION

Reference will now be made to the drawings wherein like numerals refer to like parts throughout. Exemplary embodiments of the present invention are illustrated in the context of a multi-function toilet tank device placed on a toilet fixture having a toilet tank, a removable tank lid covering the toilet tank, and a toilet bowl having a bowl rim. The skilled artisan will readily appreciate, however, that the materials and methods disclosed herein will have application in a number of other contexts where diffusion of an air-treatment concentrate to the ambient air and dissolution or dispersal of a water-treatment concentrate into a liquid storage tank is desirable, particularly where ease of use is important.

The aforementioned needs may be satisfied by the multi-function toilet device of the present invention which includes a connector with an air-treatment end portion and a water-treatment end portion opposite the air-treatment end portion; an air-treatment concentrate coupled to the air-treatment end portion of the connector; and a water-treatment concentrate coupled to the water-treatment end portion of the connector. The connector may be configured to position the air-treatment concentrate adjacent an exterior surface of the toilet tank and to position the water-treatment concentrate adjacent an interior surface of the toilet tank at least partially below the fill-level of the toilet tank. As discussed in greater detail below, the connector may form an air passage between the air-treatment portion and a bellows section of the water treatment portion.

In use the tank lid of the toilet may be removed, and the connector may be placed over the lip of the tank to position the air-treatment concentrate adjacent the exterior surface of the tank and to position the water-treatment concentrate adjacent the interior surface of the tank below the fill-level of the tank.

Figure 1A:
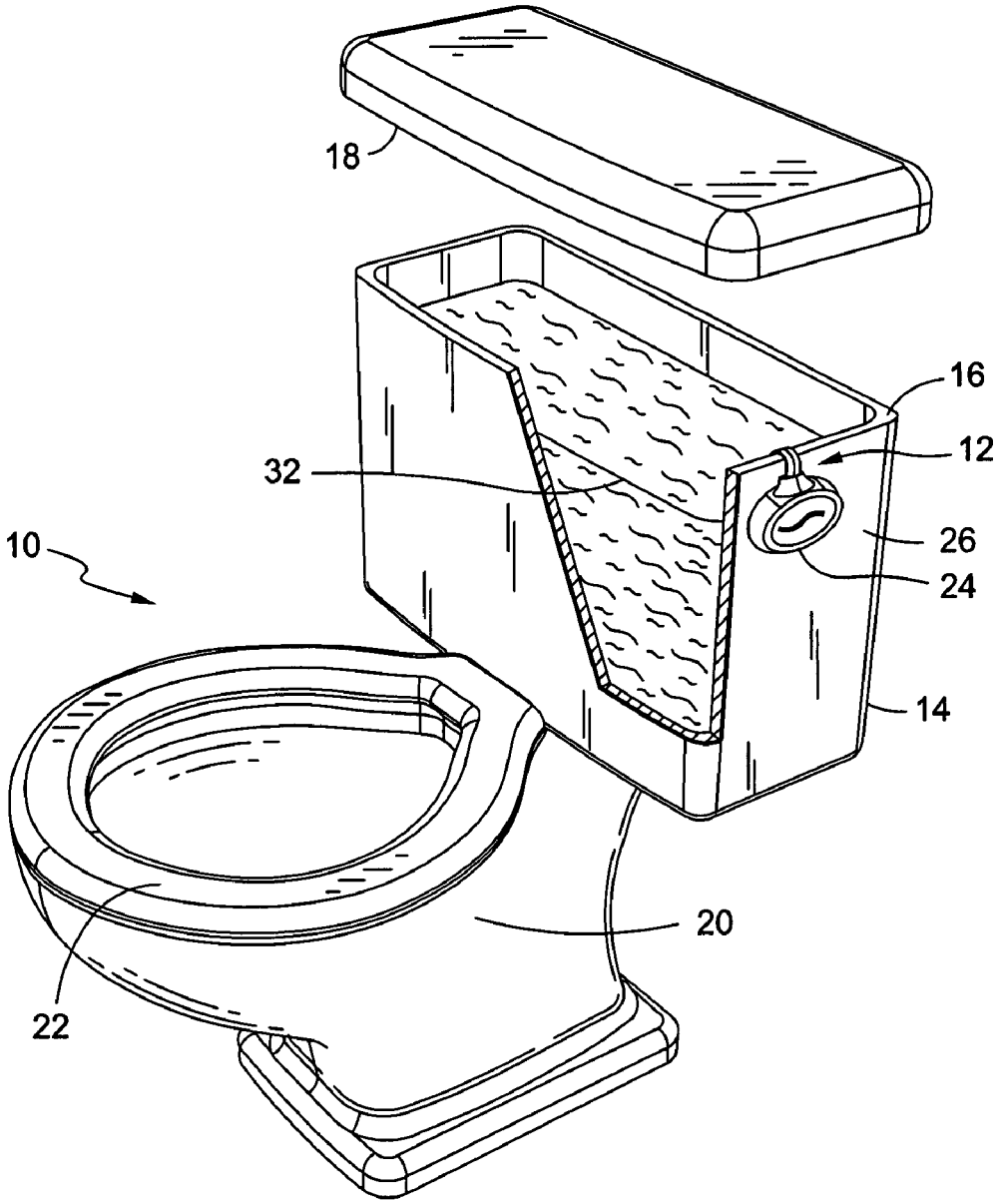
FIG. 1A shows a right side perspective view of a toilet containing a multi-function toilet device in accordance with the principles of the present invention.
Figure 1B:
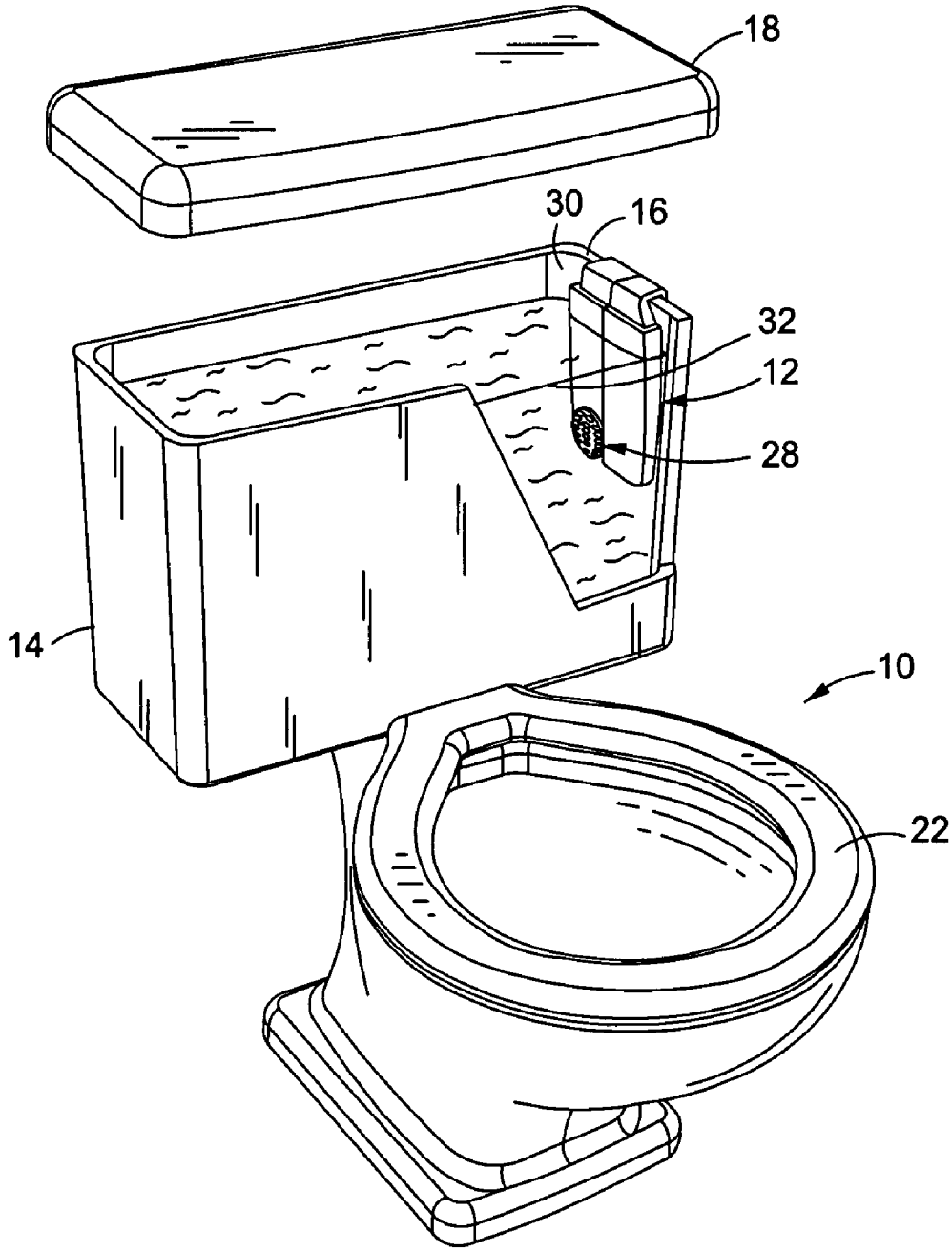
FIG. 1B shows a left side perspective view of the toilet containing the multi-function toilet device of FIG. 1A.

More particularly, FIG. 1A shows a right side perspective view of a toilet 10 containing a multi-function toilet device 12 in accordance with the principles of the present invention. FIG. 1B shows a left side perspective view of the toilet 10 containing the multi-function toilet device 12 of FIG. 1A. Referring to FIGS. 1A and 1B together, toilet 10 includes a toilet tank 14 having a toilet tank lip 16 at the top of the toilet tank 14, a toilet tank lid 18 which may fit on the toilet tank lip 16, and a toilet bowl 20 having a toilet bowl rim 22. While FIGS. 1A and 1B shows the multi-function toilet device 12 mounted on the right side of the toilet tank 14, the multi-function toilet device 12 may be mounted on other portions of the toilet tank lip 16. As shown in FIG. 1A, an air treatment portion 24 of the multi-function toilet device 12 may be mounted on an exterior portion 26 of the toilet tank 14. As shown specifically in FIG. 1B, a water treatment portion 28 of the multi-function toilet device 12 may be mounted on an interior portion 30 of the toilet tank 14. As will be discussed in more detail below, the water treatment portion 28 may be mounted below a water line 32 inside the toilet tank 14. When the toilet 10 is flushed, the water line 32 may move below the water treatment portion 28.

Figures 2A, 2B, 2C, 2D, 2E:
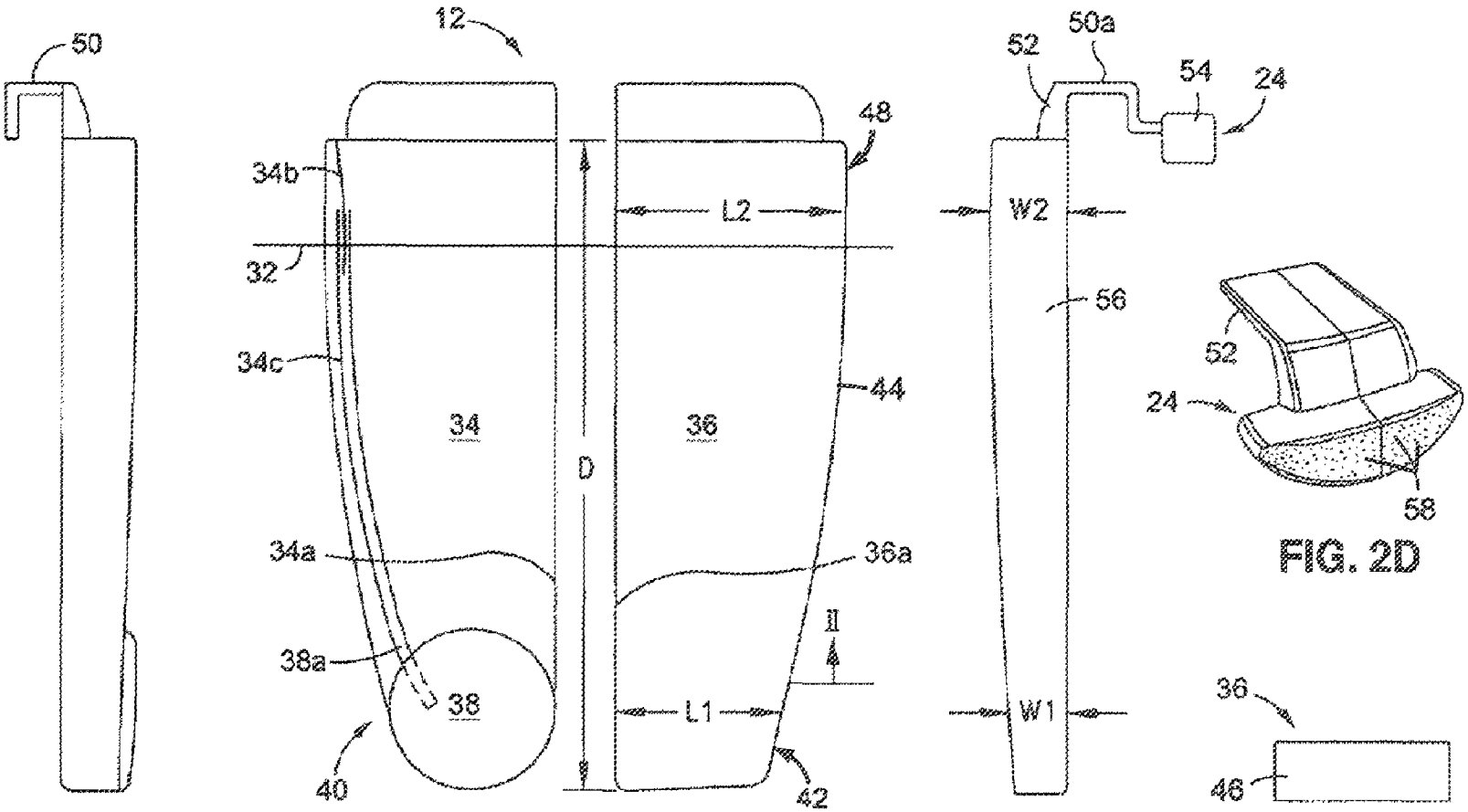
FIG. 2A shows a front side view of a multi-function toilet device of the present invention.
FIG. 2B shows a left side view of the multi-function toilet device of FIG. 2A.
FIG. 2C shows a right side view of the multi-function toilet device of FIG. 2A.
FIG. 2D shows a perspective view of the air-treatment portion of the multi-function toilet device of FIG. 2A.
FIG. 2E shows a cross-sectional view of the bottom of the air-treatment portion of the multi-function toilet device of FIG. 2A.

Referring now to FIG. 2A, there is shown a front side view of the multi-function toilet device 12 according to one embodiment of the present invention. The multi-function toilet device 12 may include a water treatment side 34 and an air moving side 36. The water treatment side 34 and the air moving side 36 may have flat sides 34*a*, 36*a* that allow the water treatment side 34 and the air moving side 36 to be pushed together as to appear as a single unit. Alternatively, the water treatment side 34 may be formed integrally with the air moving side 36. In a further alternate embodiment, the water treatment side 34 may be separately located on the toilet tank 14 from the air moving side 36. In one embodiment of the present invention, as discussed above, the air moving side 36 may be made of a material which dissolves in water over time. For example, the air moving side 36 may be made of water treatment material. In this case, as shown below with reference to FIG. 7, the water treatment side 34 may not be necessary. The air treatment side 36 may be designed to dissolve away at such a rate whereby dissolution may occur when it is desirable to replace the air treatment portion and/or the water treatment portion.

The water treatment side 34 may contain a water treatment concentrate 38. In one embodiment of the present invention, the water treatment concentrate 38 may be disposed at a lower end 40 of the water treatment side 34 such that the water treatment concentrate 38 is below the water line 32 (see FIGS. 1A and 1B) during at least a portion of a flush cycle. Hereinafter, a "flush cycle" may be defined as the action of the water level in the toilet tank, going from a full level (as indicated, for example, by the water line 32 of FIGS. 1A and 1B), to a flushed level (not shown), and returning to a full level. Alternatively, the water treatment concentrate 38 may be located at a location above the water line 32 with a means, as is known in the art, such as with an active pumping or a dosing type of water treatment concentrate dispenser, for delivering the water treatment concentrate 38 into the toilet tank 14 at the appropriate times (e.g., during a flush cycle or after a flush cycle).

In one embodiment of the present invention, a portion of a space 38*a* above the water treatment concentrate 38 may be sealed off from water until such time when the water treatment concentrate 38 needs replacement. This portion of space may be, for example, a tube 34*c* running from the water treatment concentrate 38 inside the water treatment side 36 of the multi-function toilet device 12. When the water treatment concentrate 38 is used to a point where replacement is needed, water from the toilet tank 14 may enter the tube 34*c*. A wick 34*b* may be present in the tube 34*a*, below the water line 32 of the toilet tank 14. The wick 34*b* may be disposed from inside to tube 34*c* to the outside of the toilet tank 14 such that the wick is at least partially disposed at the exterior of the toilet tank. The wick 34*b* may change color when wet to indicate to the consumer that the water treatment concentrate is in need of replacement. Color change of the wick 34*b* is one example of replacement time indication. The present invention may include alternate replacement time indication methods, as would be apparent to one skilled in the art. For example, the wick 34*b*, when wet, may activate a switch that turns on a light, such as an LED (not shown) on the outside of the toilet tank 14. In another embodiment, the portion of a space 38*a* above the water treatment concentrate 38 is not sealed off and the wick 34*b* measures a property of the water surrounding the dissolving water treatment concentrate 38, such as pH or bleach concentration. When the water treatment concentrate is substantially or fully dissolved, the wick 34*b* signals a change in the water properties via a method such as color of light.

The water treatment concentrate 38 may be any water-dispersible compound formulated to treat toilet flush water. Examples of suitable compounds include, but are not limited to, bleaches, surfactants, disinfectants, inorganic compounds, chelators, optical brighteners, and mixtures thereof. Furthermore, the water treatment concentrate 38 may be formulated to include components, such as polymers, that protect or modify toilet bowl interior surfaces, or components that protect or treat toilet valve parts. The water treatment concentrate 38 may be in the form of a liquid, solid, semi-solid, impregnated nonwoven substrate, impregnated cellulosic substrate, impregnated solid or in other forms suitable for use in water treatment applications.

Figure 3:
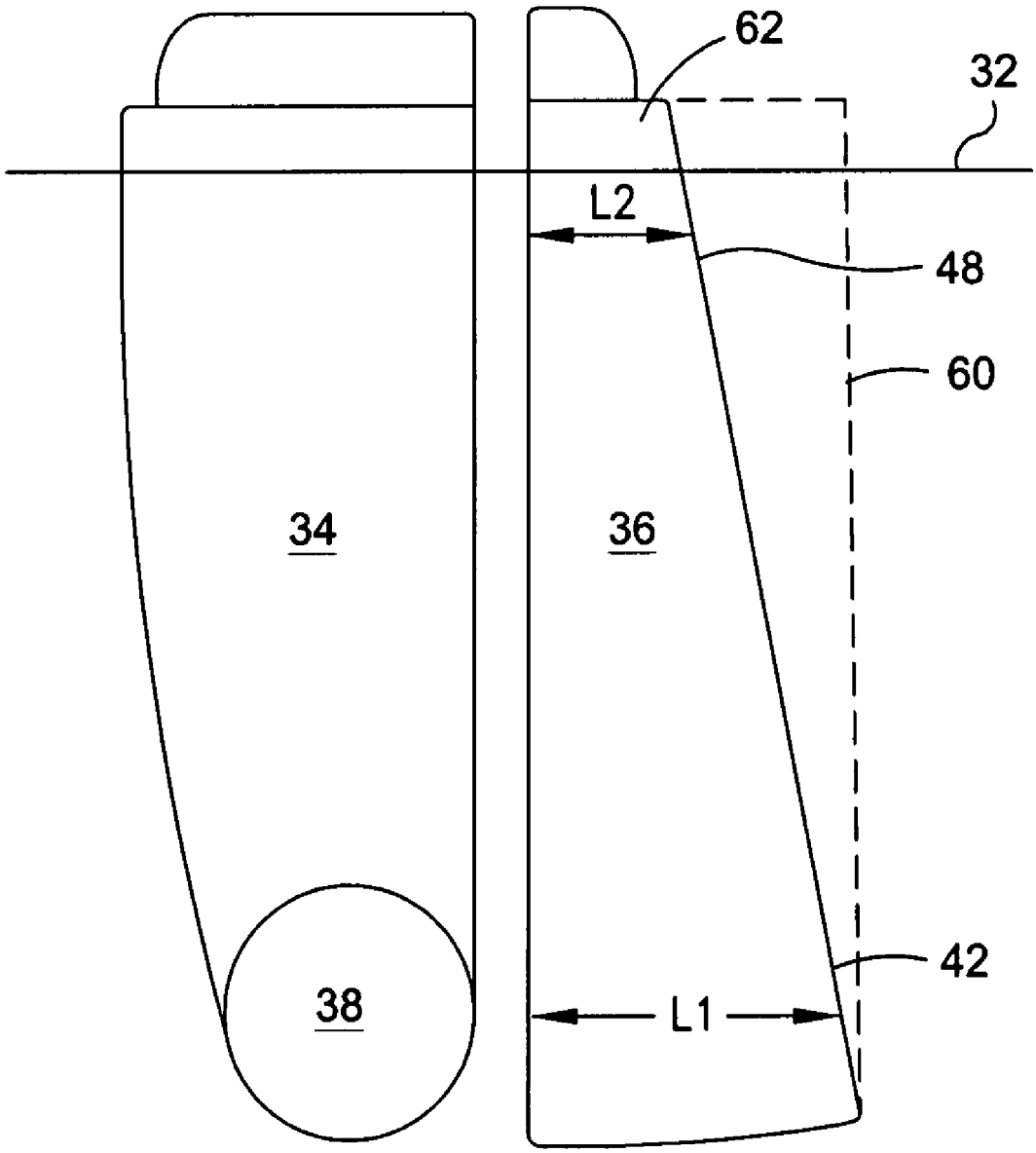
FIG. 3 shows a front side view of another embodiment multi-function toilet device of the present invention.

Referring to FIG. 2E, there is shown a cross-sectional view from a bottom end 42 of the air moving side 36 of the multi-function toilet device 12 of FIG. 2A. The air moving side 36 may include a housing 44 having an opening 46 at the bottom end 42 thereof. In one embodiment of the present invention, a cross-sectional area of the lower end 42 of the air moving side 36 may be less than a cross-sectional area of an upper end 48 of the air moving side 36. This differential cross-sectional area along a depth D of the air moving side 36 may be realized, for example, by forming the lower end 42 with a first length L1 that is less than a second length L2. This differential cross-sectional area may also be realized (either separately or in combination with the different lengths L1, L2) by forming the lower end 42 with a first width W1 (see FIG. 2C) that is greater than a second width W2 formed at the upper end 48. Alternatively, as shown in FIG. 3, the lower end 42 may be formed with the first length L1 that is greater than the second length L2.

Referring to FIG. 2B, there is shown a left side view of the multi-function toilet device 12 of FIG. 2A. The water treatment side 34 may be attached to the toilet tank 14 by a bracket 50. Alternatively, any conventional means may be used to affix the multi-function toilet device 12 to the toilet tank 14. For example, water-proof adhesive may be used to attach the multi-function toilet device 12 to the toilet tank 14. As discussed above, the water treatment side 34 may include the water treatment concentrate 38 at the lower end 40 of the water treatment side 34.

Referring to FIG. 2C, there is shown a right side view of the multi-function toilet device 12 of FIG. 2A. The air moving side 36 may be attached to the toilet tank 14 by a bracket 50*a*. The bracket 50*a* may include an air passage 52 for communicating an interior 54 of the air treatment portion 24 with an interior 56 of the air moving side 36. This interior 56 of the air moving side 36 may also be referred to as a bellows 56, as when water fills the toilet tank, the volume of air inside the bellows 56 may be expelled through the air passage 52 as the air inside the bellows 56 is replaced by water. The air expelled through the air passage 52 may pass through the air treatment portion 24 and be delivered to freshen the air in the room containing the toilet 10.

Referring to FIG. 2D, there is shown a perspective view of the air-treatment portion 24 of the multi-function toilet device 12 of FIG. 2A. The air treatment portion 24 may receive air through the air passage 52. The air may pass through an air treatment concentrate (not shown) located within the interior 54 of the air treatment portion 24. Holes 58 may be formed in the air treatment portion to allow the air from the air passage 52 to flow over the air treatment concentrate, through the holes 58 and into the room containing the toilet 10. In one embodiment, as shown in FIG. 2D, the holes 58 may be formed opposite from where the air passage 52 joins with the air treatment portion 24. Such a configuration may allow for the air in the air passage 52 to pass over the air treatment concentrate before being expelled to the ambient surroundings (such as the room containing the toilet 10). In one embodiment, the air treatment concentrate is visible through the holes 58, or the front part of the air treatment portion 24 with the holes 58 may be of a transparent or translucent material that allows the consumer to view the air treatment concentrate. The air treatment concentrate may change color as the active concentrate is changed, as indicated below. In one embodiment, the front part of the air treatment portion may be sealed by a removable tab (not shown). When the consumer uses the device and removes the tab, the front of the air treatment portion 24 may have a time indicator that reacts with the air and starts a time period for consumer use, wherein the time indicator changes color to indicate to the consumer that it is time to change the air treatment housing or the air treatment concentrate. It may also signal to the consumer that it is time to change both the air treatment concentrate and the water treatment concentrate.

The air treatment concentrate (not shown) may be any conventional air treatment concentrate, as described above. In one embodiment of the present invention, the air treatment concentrate may change color as the fragrance is dispensed, thereby providing the consumer an indicator when the air treatment concentrate may need to be changed. It may be useful for the fragrance to be used up at approximately the same rate as the water treatment concentrate 38 is used up, thereby indicating to the consumer that both the air treatment concentrate and the water treatment concentrate 38 need to be replaced. Alternatively, the air treatment portion 24 may be formed of a material that changes color over time, thereby indicating to the consumer when replacement of the user replaceable components (e.g., the air and water treatment concentrates) may be necessary. Conventional color change technology may be employed in the air treatment portion 24 and/or the air treatment concentrate. For example, the color change technology described in U.S. Pat. Nos. 4,824,827 and 6,254,969, herein incorporated by reference, may be useful in the present invention.

The present invention may include a bellows 56 that has a differential cross-sectional area when comparing the upper end 48 with the lower end 42. As shown in FIG. 2A, this differential cross-sectional area may be realized, for example, by forming the lower end 42 with the first length L1 that is less than the second length L2. Such a configuration may provide an initially lower amount of air moving through the air treatment portion 24, as water in the toilet tank 14 begins to cover the lower end 42 of the air moving side 36 and fill the bellows 56. As the water continues to rise in the toilet tank 14, the water may continue to fill the bellows 56, expelling a greater volume of air through the air treatment portion 24. Depending on the consumer needs and market research, such a design may be beneficial in providing a greater amount of fragrant air dispensed at the end of the flush cycle. This design may also be particularly useful when a delay valve (not shown, discussed below with reference to FIG. 8) is used to increase the rate of air flow over the air treatment concentrate to deliver a more intense fragrance release/burst. In this case, as discussed in more detail below, the smaller length L1 at the lower end 42 may allow for a slow buildup of pressure before releasing the air through the air passage 52.

Alternatively, referring to FIG. 3, the differential cross-sectional area may be realized, for example, by forming the lower end 42 of the air moving side 36 with the first length L1 that is greater than the second length L2. The air moving side 36 may be formed with an exterior shape, as shown be the dotted line 60, substantially symmetrical to the water treatment side 34. This design may impart a greater initial release of fragrance compared to conventional uniform cross-sectional area designs. As the toilet tank 14 fills during the flush cycle, a greater volume of air and fragrance is displaced earlier in time, when the consumer may be more likely to desire such a fragrance concentration.

An additional benefit to the design of FIG. 3 may be realized due to the smaller length L2 at an upper end 48 of the air moving side 36. In this embodiment of the present invention, the amount of potential dead space 62 may be minimized. Dead space 62 may refer to the amount of space occupied by air in the air moving side 36 when the water line 32 in the toilet tank 14 is at a maximum position. Fills level inside various consumer toilet tanks 14 may be variable and any volume above the fill level (e.g., dead space 62) will not be dispensed. Therefore, it may be beneficial to minimize dead space 62 by having the upper end 48 of the air moving side 36 having a relatively small cross-sectional area (i.e., by a smaller length L2).

Figure 4:
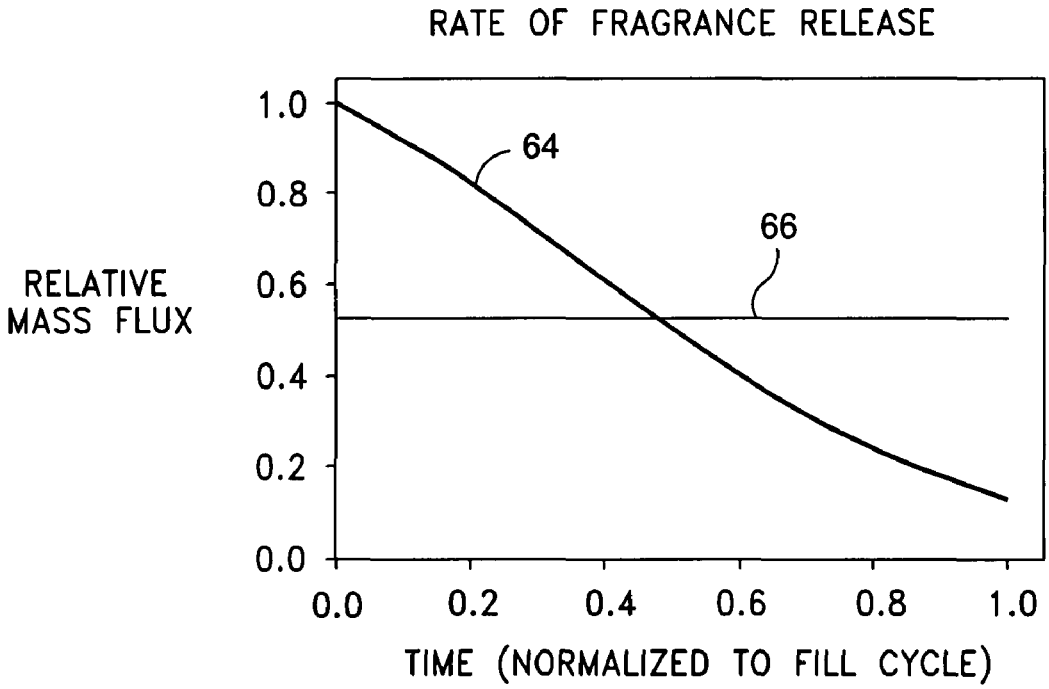
FIG. 4 is a graph showing the relative mass flux of fragrance release over time for the multi-function toilet device of the present invention, such as the multi-function toilet device of FIG. 3, as compared to a conventional toilet device.

Referring now to FIG. 4, there is shown a graph describing the exemplary rate of fragrance release over time for the multi-function toilet device 12 of FIG. 3 as compared to conventional, uniform cross-sectional area designs. The relative mass flux for fragrance release for the design of FIG. 3 may be shown by line 64 and the conventional, uniform cross-sectional area design may be shown by line 66. As can be seen from the graph, the present invention may afford a greater mass flux of fragrance early in the flush cycle.

Figure 5:
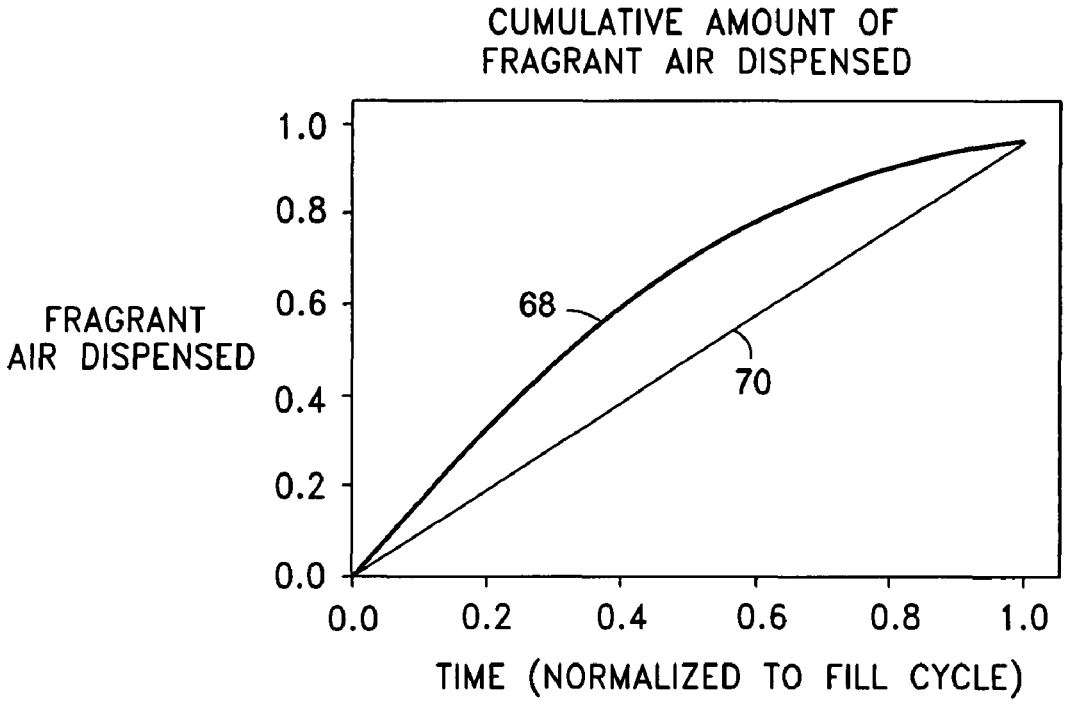
FIG. 5 is a graph showing the cumulative amount of fragrant air dispense over time for the multi-function toilet device of the present invention, such as the multi-function toilet device of FIG. 3, as compared to a conventional toilet device.

Referring to FIG. 5, there is shown a graph describing the exemplary cumulative amount of fragrant air dispensed over time for the multi-function toilet device 12 of FIG. 3 as compared to conventional, uniform cross-sectional area designs. The fragrant air dispensed for the design of FIG. 3 may be shown by line 68 and the conventional, uniform cross-sectional area design may be shown by line 70. As can be seen from the graph, the present invention may afford a greater amount of fragrant air dispensed early in the flush cycle. For example, during the first third of the flush cycle, the design of the present invention may dispense at least about 50%, and typically about 60% more fragrance as compared to the conventional design.

Figure 6A:
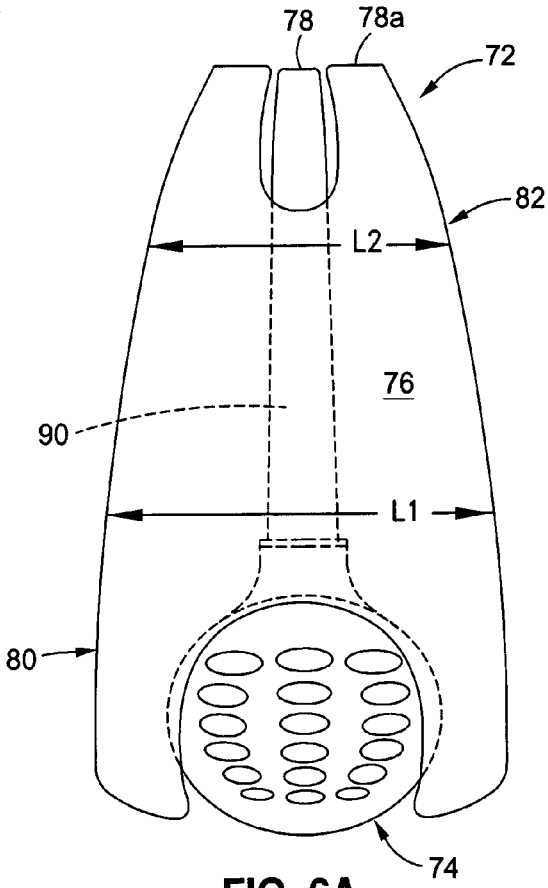
FIG. 6A shows a front side view of another embodiment of the multi-function toilet device according to the present invention.

Referring to FIG. 6A, there is shown a front side view of another embodiment of the multi-function toilet device 72 according to the present invention. Similar to the embodiment of FIGS. 2A-2E, the multi-function toilet device 72 may include a water treatment part 74 and an air moving part 76. The water treatment part 74 may be nested in the air moving part 76. The water treatment part 74 may have a bracket 78 and the air moving part 76 may have a separate bracket 78*a*. Brackets 78, 78*a* may permit the parts 74, 76 to be mounted on the toilet tank 14 as described above with reference to FIGS. 2A-2E.

A lower end 80 of the air moving part 76 may have a length L1 that is longer than a length L2 of an upper end 82 of the air moving part. This design may result in a differential cross-sectional area between the lower end 80 and the upper end 82. Such a differential cross-sectional area may impart benefits similar to those discussed above with respect to the graphs of FIGS. 4 and 5.

While FIG. 6A shows the water treatment part 74 behind the air moving part 76, in an alternate embodiment of the present invention, the water treatment part 74 may be disposed in front of the air moving part 76 in order to allow for easy replacement of the water treatment part 74. Alternatively, a channel (not shown) may be formed in the air moving part 76 for the placement of a connector 90 of the water treatment part 74.

Figure 6B:
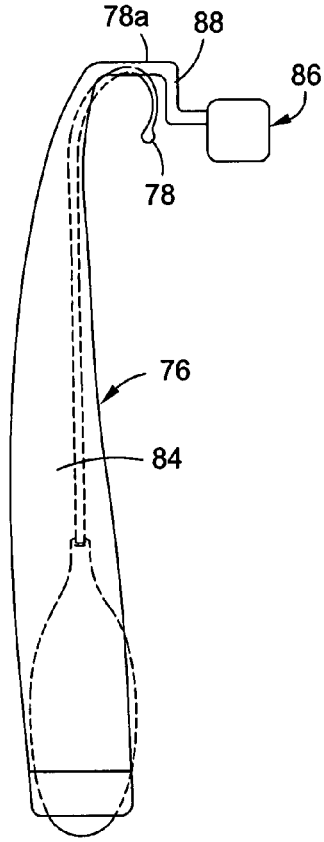
FIG. 6B shows a side view of the multi-function toilet device of FIG. 6A.
Figure 6C:
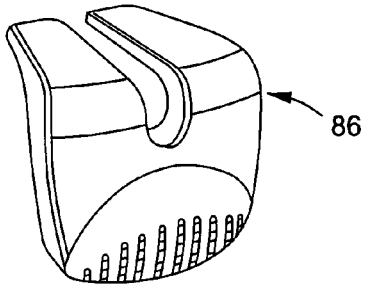
FIG. 6C shows a perspective view of the air-treatment portion of the multi-function toilet device of FIG. 6A.

Referring now to FIGS. 6B and 6C, the interior of the air moving part 76 may form a bellows 84 which may be in communication with an air treatment portion 86 via an air passage 88. As the water level in the toilet tank 14 increases, the air displaced by water in the bellows 84 may flow through the air passage 88 and through the air treatment portion 86 to release fragrance contained therein.

While the above embodiments described particular embodiments of the present invention, the embodiments should not be taken in a limited sense. Modifications within the skill of those in the art are included in the scope of the present invention. Furthermore, certain other features and designs may be included in the present invention, including those shown in FIGS. 7-10 below.

Figure 7:
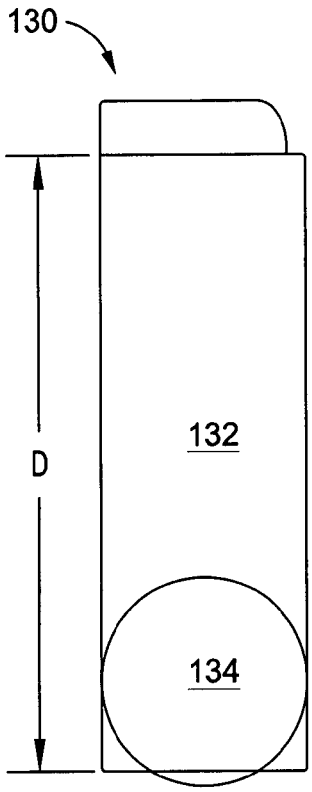
FIG. 7 is a front side, cross-section view of another embodiment of the multi-function toilet device according to the present invention.

Referring to FIG. 7, there is shown a front side view of another embodiment of the multi-function toilet device 130 according to the present invention. The air moving side 132 may be made of a material which dissolves in water over time. For example, the air moving side 132 may be made of water treatment material (such as water treatment material 38, as described above). In this case, a water treatment side may not be necessary. Alternatively, the air moving side 132 may be made, at least partially of any water soluble material. In this case, a water treatment concentrate 134 may be disposed on the air moving side 132.

The air treatment side 132 may be designed to dissolve away at such a rate whereby dissolution may occur when it is desirable to replace the air treatment portion and/or the water treatment portion. In this embodiment of the present invention, the air treatment side 132 need not have a differential cross-sectional area along its depth D. The air treatment side 132 may have a substantially uniform cross-sectional area along its depth D, as shown, or the air treatment side 132 may have a differential cross-sectional area along its depth D, for example, as shown in FIGS. 2A-3. The use of a dissolving air treatment portion 132 may be useful in any of the embodiments of the present invention, for example, the embodiments of FIGS. 2A-2E, FIG. 3, FIGS. 6A-6C, and FIGS. 8, 9, 10 and 11.

Figure 8:
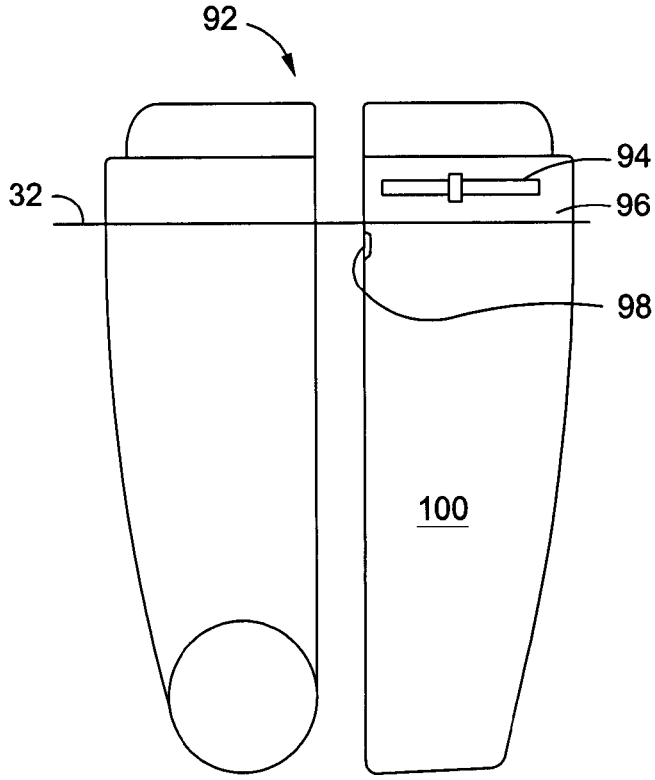
FIG. 8 is a front side, cross-sectional view of the multi-function toilet device of the present invention having a fan disposed therein.

Referring to FIG. 8, there is shown a front side, cross-sectional view of a multi-function toilet device 92 of the present invention having a fan 94 disposed therein. The fan 94 may be located in a dead space 96 (that is, the portion of the air moving side 100 that is above the water line 32 when the toilet tank 14 is full) of the air moving side 100. In this configuration, the fan 94 may be designed to run continuously or, alternatively, a sensor 98 may be employed to determine when the toilet 10 is in a flush cycle by, for example, detecting the water level 32 in the toilet tank 14. In an alternate configuration (not shown), the fan 94 may be located below the dead space 96 and may be turned on only when the water line moves below the fan 94. Regardless of the particular configuration, the fan 94 may provide an increased air flow through the air treatment portion (See FIGS. 2D and 6C).

The fan 94 may be powered by a power supply (not shown), such as a battery, or the fan 94 may be driven by the air flow caused by water displacing air in the air moving part 100 during the flush cycle. In either case, the fan may provide improved fragrance delivery as well as a cue for the consumer of the operation of the multi-function toilet device 92.

Figure 9:
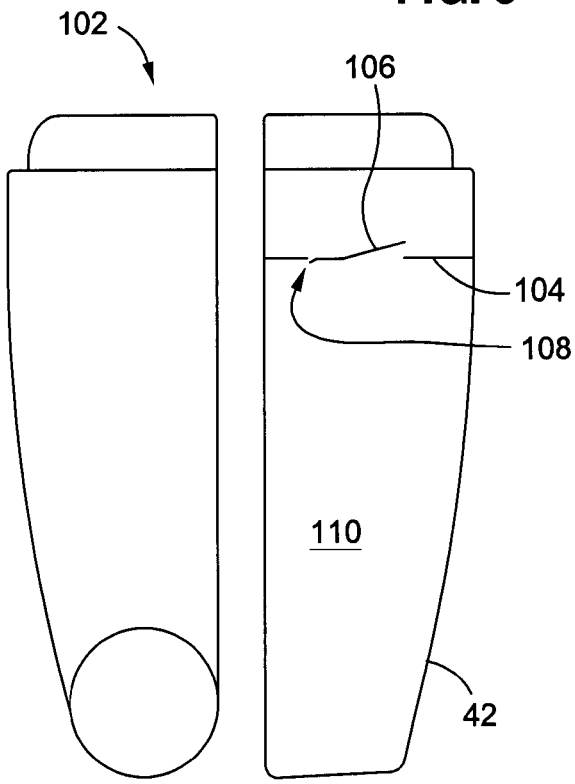
FIG. 9 is a front side, cross-sectional view of the multi-function toilet device of the present invention having a delay valve disposed therein.

Referring to FIG. 9, there is shown a front side, cross-sectional view of a multi-function toilet device 102 of the present invention having a delay valve 104 disposed therein. The delay valve 104 may be positioned at any location within an air moving side 110 of the multi-function toilet device 102. For example, the delay valve 104 may be located above the water line 32 when the toilet tank 14 is full or the delay valve 104 may be located below the water line 32. Alternatively, the delay valve 104 may be disposed within the air passage (e.g., air passage 52 of FIG. 2C) communicating the air moving part 110 to the air treatment part. The delay valve 104 may be of a design that will open once a predetermined pressure is achieved below the delay valve 104. For example, the delay valve 104 may include a hinged flap 106 designed to open to release air through an air passage to the air treatment part as previously described. The delay valve 104 may increase the rate of air flow over the air treatment concentrate to deliver a more intense fragrance release/burst. The delay valve 104 may include a check valve 108 to allow air to flow into the lower end 42 of the air moving side 110, thereby allowing the water to exit from the air moving side 110 during the flush cycle.

Figure 10:
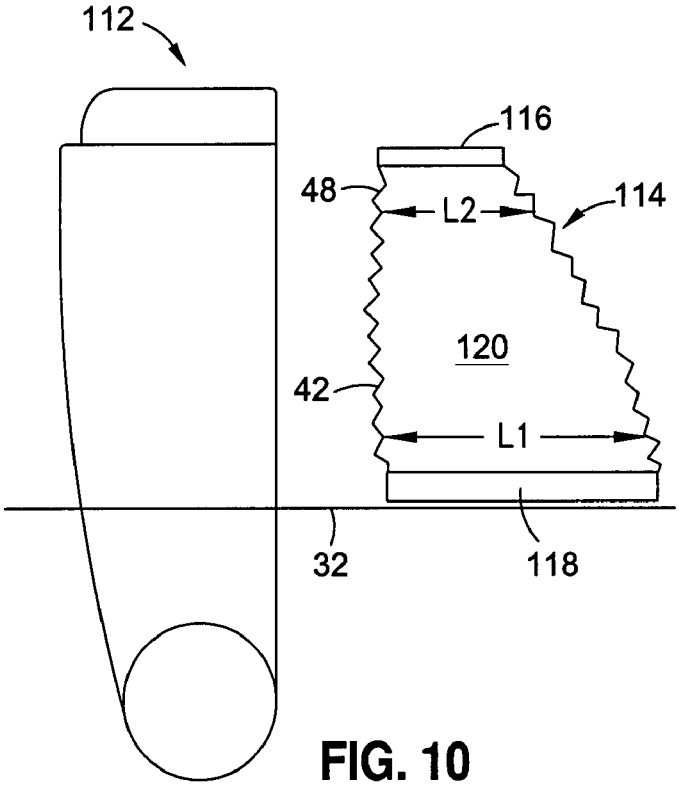
FIG. 10 is a front side, cross-sectional view of the multi-function toilet device of the present invention having a collapsible bellows.

Referring to FIG. 10, there is shown a front side, cross-sectional view of a multi-function toilet device 112 of the present invention having a collapsible bellows 114 disposed therein to act as the air moving part as described in the embodiments above. The collapsible bellows 114 may have a fixed end 116 and a floating end 118. The fixed end 116 may be attached to either the toilet tank 14 or the toilet lid 18. The floating end 118 may be designed to float at the water line 32. A bellows 120 may be formed between the fixed end 116 and the floating end 118. The length L1 of the lower end 42 of the bellows 120 may be different from the length L2 of the upper end 48 of the bellows 120. This difference between L1 and L2 may provide a differential cross-sectional area of the bellows from the lower end 42 to the upper end 48, thereby providing a variable flow of fragrance from the air treatment part (not shown).

Figure 11:
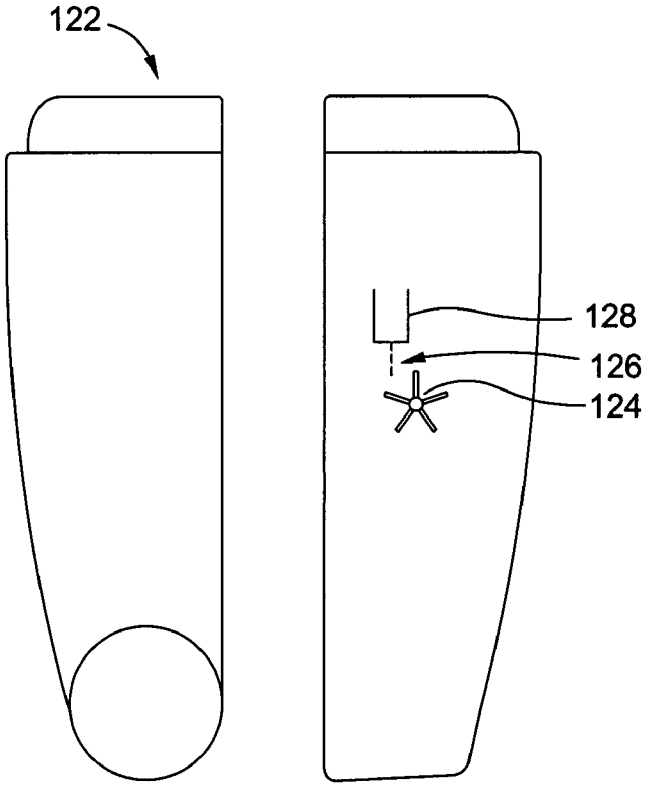
FIG. 11 is a front side, cross-sectional view of the multi-function toilet device of the present invention having a paddle disposed therein.

Referring to FIG. 11, there is shown a front side, cross-sectional view of a multi-function toilet device 122 of the present invention having a paddle 124 disposed therein. The paddle 124 may be driven by a flow 126 from a secondary chamber, such as a cup 128, when the water level 32 moves below the cup 128. The cup 128 may fill when the water level is above the cup 128 (e.g., prior to a flush cycle). The paddle 124 may spin to provide an increased air flow through the air treatment portion (See FIGS. 2D and 6C).

This invention has been described herein in detail to provide those skilled in the art with information relevant to apply the novel principles and to construct and use such specialized components as are required. However, it is to be understood that the invention can be carried out by different equipment, materials and devices, and that various modifications, both as to the equipment and operating procedures, can be accomplished without departing from the scope of the invention itself.

We claim:

1. A device comprising:

an air moving part for mounting inside a toilet tank and including an opening for permitting movement of air through the air moving part;

an air treatment part in communication with an interior of the air moving part via an air passage, the air treatment part being mounted outside the toilet tank when the device is mounted onto the toilet tank; and an indicator configured to be at least partially viewable from an exterior of the toilet tank when the device is mounted onto the toilet tank;

a water treatment part for mounting inside a toilet tank;

wherein air displaced from the interior of the air moving part moves through the air treatment part from a first end of the air moving part to a second end of the air moving part, wherein the second end is adjacent to the air passage;

wherein the indicator is configured to indicate that one or more components of the device need replacement; and wherein said water treatment part includes a tube communicating a water treatment concentrate disposed in the water treatment part with an upper end of the water treatment part.

2. The device of claim 1, wherein the one or more components includes at least one of the water treatment concentrate and an air treatment concentrate.

3. The device of claim 1, wherein cross-sectional area of the first end is different than cross sectional area of the second end.

4. The device of claim 3, wherein cross-sectional area of the interior decreases from a lower end of the interior to an upper end of the interior.

5. The device of claim 1, wherein the water treatment part is disposed adjacent to the air moving part.

6. The device of claim 1, wherein the water treatment part is formed integrally with the air moving part.

7. The device of claim 1, wherein the indicator comprises a wick configured to extend at least partially to the exterior of the toilet tank when the device is mounted onto the toilet tank.

8. A device comprising:

an air moving part configured to mount inside a toilet tank and including an opening for permitting movement of air through the air moving part;

an air treatment part in communication with an interior of the air moving part;

a water treatment part configured to mount inside a toilet tank;

an indicator configured to be at least partially viewable from an exterior of the toilet tank when the device is mounted onto the toilet tank; and a tube communicating a water treatment concentrate disposed in the water treatment part with an upper end of the wafer treatment part, wherein the indicator comprises a wick configured to extend at least partially to the exterior of the toilet tank when the device is mounted onto the toilet tank;

wherein the tube permits passage of water from the toilet tank when the water treatment concentrate needs replacement when the device is mounted onto the toilet tank;

wherein air displaced from the interior of the air moving part moves through the air treatment part; and wherein the indicator is configured to indicate that one or more components of the device need replacement.

9. The device of claim 7, wherein the wick changes colors when the one or more components need replacement.

10. The device of claim 2, wherein the one or more components includes the air treatment concentrate, and wherein the air treatment concentrate is configured to change color when the air treatment concentrate needs replacement.

* * * * *